United States Patent [19]

Marotto

[11] 4,141,402

[45] Feb. 27, 1979

[54] VENETIAN BLIND TILTER OPERATING MECHANISM WITH SNAP-ON WAND CONNECTION

[75] Inventor: Anthony F. Marotto, Philadelphia, Pa.

[73] Assignee: Marathon Manufacturing Company, Houston, Tex.

[21] Appl. No.: 849,402

[22] Filed: Nov. 7, 1977

[51] Int. Cl.[2] ..... E06B 9/26

[52] U.S. Cl. ..... 160/176 R

[58] Field of Search ..... 160/166–178; 16/114 R, 171, DIG. 3; 24/201 TR, 201 HE, 205 TC; 74/543, 544, 548

[56] References Cited

U.S. PATENT DOCUMENTS

| | | | |
|---|---|---|---|
| 3,175,420 | 3/1965 | Craig | 74/544 |
| 3,425,479 | 2/1969 | Lorentzen et al. | 160/176 R |
| 3,471,874 | 10/1969 | Dixon | 16/171 |
| 3,579,745 | 5/1971 | Wilson | 24/201 TR |
| 3,918,513 | 11/1975 | Englung et al. | 160/176 R |

*Primary Examiner*—Peter M. Caun

*Attorney, Agent, or Firm*—Robert K. Youtie

[57] ABSTRACT

A tilter operating mechanism for a venetian blind including a stub shaft depending from a head rail and rotatable to tilt the blind slats, a cross piece or pin on the lower stub shaft end, and an operating rod or wand having on one end a resilient clip for snap assembly with the cross piece, so that the wand is rotatable in opposite directions to effect desired slat tilting.

3 Claims, 4 Drawing Figures

VENETIAN BLIND TILTER OPERATING MECHANISM WITH SNAP-ON WAND CONNECTION

BACKGROUND OF THE INVENTION

While there are in the prior art rod or wand operated venetian blind tilter mechanisms, wherein the operating rod or wand is readily connectable to and disconnectable from a rotary operating shaft, such prior connections have generally involved interfitting hooks and eyes, and the like, and have been too readily subject to accidental or otherwise undesired disconnection when in use. That is, it is often desirable to store and ship venetian blinds with the operating rod or wand separate or disconnected from the blind, while permitting of easy connection on installation of the blind. However, prior hook and eye or universal type rod connections have been either subject to inadvertent disconnection or of relatively expensive complexity. Illustrative of the problem is prior U.S. Pat. No. 3,425,479.

SUMMARY OF THE INVENTION

It is an important object of the present invention to provide, in a venetian blind assembly, a tilter operating mechanism including a rotary stub or worm shaft, an operating rod or wand in end-to-end relation with the shaft, and universal type joint means connecting the stub shaft and operating rod together for transmitting motion from the latter to the former, and which permits of quick and easy assembly by connection therebetween while effectively resisting inadvertent, accidental or otherwise undesired disconnection, but enables the operating rod to be readily and simply deliberately separated from the stub shaft when required.

It is a further object of the present invention to provide a venetian blind tilter operating mechanism having the advantageous characteristics mentioned in the preceding paragraph, which is extremely simple and staunch in structure, for economy in manufacture, and durability and reliability throughout a long, useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
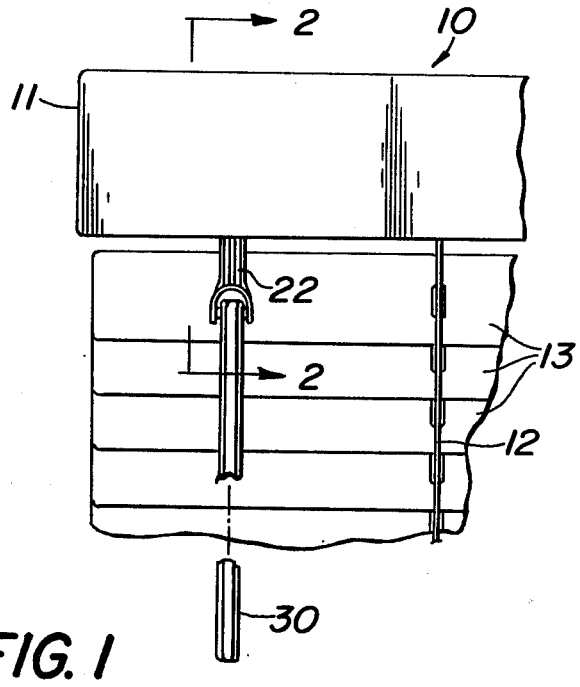
FIG. 1 is a partial elevational view showing a venetian blind constructed in accordance with the teachings of the present invention, in an operative condition of use.
Figure 3:
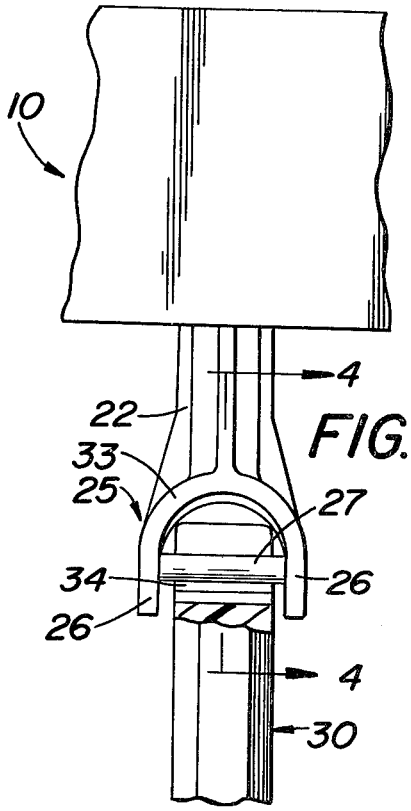
FIG. 3 is a partial sectional elevation view taken generally along the line 3—3 of FIG. 2.
Figure 2:
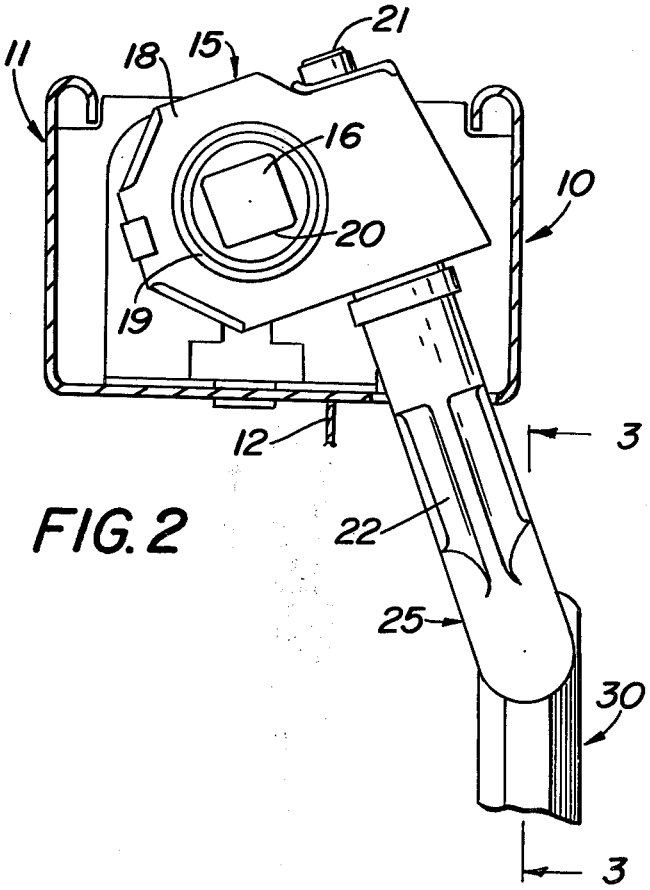
FIG. 2 is a partial sectional elevation view taken generally along the line 2—2 of FIG. 1, slightly enlarged and illustrating the operating mechanism.

Referring now more particularly to the drawings, and specifically to FIGS. 1-3 thereof, a venetian blind of the present invention is thereby generally designated 10, and includes an upper channel or head rail 11, a slat suspension ladder 12, and a plurality of generally horizontally extending, superposed slats 13 carried by the ladder 12 beneath the head rail 11.

Mounted interiorly of the channel or head rail 11 is a tilt operating mechanism, generally designated 15, and extending longitudinally within the head rail or channel 11 is a rotatably supported or journaled tilt rod or shaft 16 suitably connected to the ladders 12 for effecting rotary oscillation or tilting of the slats 13 upon rotary oscillation of the tilt rod.

As thus far described, the venetian blind structure may be generally conventional.

The operating mechanism 15 may include a generally conventional worm-and-wheel assembly 18 mounted with the wheel 19 having a noncircular central opening 20 for conformably receiving the similarly cross sectionally configured tilt rod 16. Thus, rotation of the gear wheel 19 effects rotation of tilt rod 16.

A worm shaft 21 is mounted in conventional meshing engagement with the gear wheel 19 of the operating mechanism 18, so that axial rotation of the worm shaft 21 effects axial rotation of the worm wheel 19 and tilt rod 16.

The worm shaft 21 depends obliquely downwardly and forwardly or outwardly, as at 22, through the wall of the head rail channel 11 and forwardly of the slats 13. The worm or operating shaft 22 terminates proximate to and spaced below the underside of the head rail 11, forward of the uppermost couple or few slats 13. The worm shaft 22 is thus fairly short, and may be considered as a projecting stub shaft.

Figure 4:
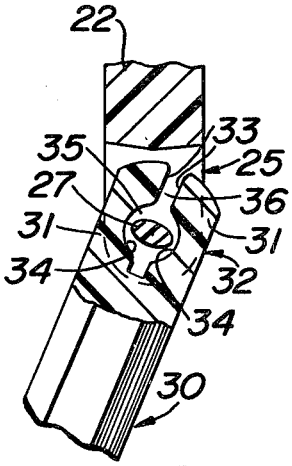
FIG. 4 is a partial sectional elevation view taken generally along the line 4—4 of FIG. 3.

Provided on the lower or projecting end of operating or stub shaft 22 is a downwardly projecting bifurcated or inverted U-shaped member generally designated 25. More particularly, the bifurcated member 25 may include a pair of laterally spaced extensions or arms 26, extending in substantial parallelism with each other and longitudinally outwardly from the lower end of stub shaft 22. The arms 26 are therefore disposed in depending relation generally oblique to the vertical. Extending between the arms 26, generally normal thereto, is a cross piece or pin 27. As best seen in FIG. 4, the cross piece or pin 27 is of noncircular cross sectional configuration, being oblate or laterally distended or elongate in a direction transverse of the stub shaft 22 and its longitudinally extending arms 26.

While the stub shaft 22 and its bifurcated end member are illustrated as integrally formed of plastic, say by injection molding, it is appreciated that other materials and modes of fabricating may be employed, as desired.

In the illustrated embodiment, the major transverse axis of the cross sectional configuration of cross piece or pin 27 extends generally oblique to the longitudinal direction of stub shaft 22 and U-shaped connector part 25. Thus, the transverse cross sectional elongation of pin or cross piece 27 is neither longitudinal of or normal to the stub shaft 22, but preferably at an acute angle of about 70° with the longitudinal direction of the stub shaft. This has been found entirely satisfactory in operation of the tilting mechanism, as well as in assembly and disassembly of the parts, while also effective in preventing undesired disassembly.

In end-to-end relation with the depending end of stub shaft 22 is an elongate operating rod, wand or baton, generally designated 30. The wand 30 may be of equilateral polygonal cross section, as illustrated, or of other suitable cross section, and may be provided on its upper end with a pair of generally longitudinally extending, parallel spaced resiliently deflectable legs 31. The facing spaced legs 31 combine to define a snap clip, generally designated 32. More specifically, the legs 31 on their facing sides 33 are formed with facing, concave or undercut surfaces 34. The facing undercuts or concave surfaces 34 may be generally arcuate and approximately circular, so as to define therebetween an enlarged, generally circular space 35, communicating through a restricted space or throat 36, with the exterior of the clip 32 beyond the end of wand 30.

In order to assembly the wand 30 with the worm shaft 22, it is only necessary to move the same relative to each other to pass the cross piece or pin 27 through the clip throat 36, into the enlarged inner space 35, to the condition shown in FIG. 4. As the minor axis or minimum cross sectional dimension of cross piece 35 is just slightly greater than the width of throat 36, and as the legs 31 of clip 32 are resiliently deflectable outwardly away from each other, the cross piece may be snap engaged through throat 36 into space 35 with the wand 30 and rod 22 in a single angular relationship with respect to each other. The rod members 30 and 22 may not be separated or disengaged except in that certain single angular relationship. Hence, inadvertent or accidental separation is most unlikely, while deliberate and intentional separation may be quickly and easily accomplished by mere reversal of the above described operation.

Also, with the clip 32 snap engaged with the cross piece 27, there is effected an articulated joint capable of transmitting motion in a wide variety of angular relationships, so that manual rotation of wand or operating rod 30 effects rotation of stub shaft 22 to achieve the desired angle of slat tilt.

In view of the foregoing it will now be appreciated that the present invention provides a venetian blind tilter operating mechanism wherein a unique and highly advantageous articulated joint construction is provided between a worm shaft and operating rod, capable of quick and easy assembly, resisting undesired disassembly, permitting of simple intended disassembly, and otherwise fully accomplishing its intended objects.

Although the present invention has been described in some detail by way of illustration and example for purposes of clarity of understanding, it is understood that certain changes and modifications may be made within the spirit of the invention.

What is claimed is:

1. A venetian blind tilter operating mechanism comprising a head rail, a rotary stub shaft depending from the head rail and rotatable to effect slat tilting, a cross piece on the depending end of said stub shaft, a manually actuable wand for end-to-end connection to said stub shaft and gravitational dependence therefrom, a resilient clip on one end of said wand for resilient snap engagement about said cross piece, said clip including a pair of generally upwardly extending resilient legs having a space therebetween rotatably receiving said cross piece, said space having a reduced throat between the free ends of said legs, and said throat being dimensioned less than said cross piece for retention of the latter in said space against inadvertent removal and permitting of deliberate removal by the resilience of said legs, and a generally U-shaped member including a pair of laterally outwardly projecting arms on the depending end of said stub shaft, said cross piece extending between said arms, said stub shaft depending obliquely inwardly from said head rail, and said cross piece being of laterally distended cross sectional configuration oblique to said stub shaft so that the major axis of said laterally distended cross section does not pass through a vertical position so as to prevent inadvertent disengagement of the clip and removal of the wand, while said cross piece presents its minor axis for snap engagement into said clip with the wand unobstructed by the environment.

2. A venetian blind tilter operating mechanism according to claim 1, said legs having their facing sides arcuately undercut to define said space for rotatably receiving said cross piece.

3. A venetian blind tilter operating mechanism according to claim 2, said cross piece being of oblate cross sectional configuration for snap engagement between said legs into the undercuts thereof.

* * * * *